US006790105B2

(12) United States Patent
Fukatsu et al.

(10) Patent No.: US 6,790,105 B2
(45) Date of Patent: Sep. 14, 2004

(54) MALE TERMINAL FITTING

(75) Inventors: Yukihiro Fukatsu, Yokkaichi (JP); Yuuichi Nankou, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/414,550

(22) Filed: Apr. 14, 2003

(65) Prior Publication Data

US 2003/0199211 A1 Oct. 23, 2003

(30) Foreign Application Priority Data

Apr. 18, 2002 (JP) ..... 2002-116119

(51) Int. Cl.[7] ..... H01R 9/24
(52) U.S. Cl. ..... 439/884
(58) Field of Search ..... 439/884, 866, 439/862, 825, 877, 849, 850, 879

(56) References Cited

U.S. PATENT DOCUMENTS 5,664,974 A * 9/1997 Endo et al. ..... 439/884
5,795,197 A * 8/1998 Tsuji et al. ..... 439/884
5,888,107 A * 3/1999 Seymour et al. ..... 439/891
6,217,379 B1 * 4/2001 D'Hulster et al. ..... 439/752.5
6,625,884 B1 * 9/2003 Fukase et al. ..... 29/863
6,638,117 B2 * 10/2003 Murakami et al. ..... 439/849
6,659,814 B2 * 12/2003 Kojima ..... 439/884
6,666,733 B2 * 12/2003 Takatsuki et al. ..... 439/884

* cited by examiner

*Primary Examiner*—Ross Gushi
*Assistant Examiner*—Phuongchi Nguyen
(74) *Attorney, Agent, or Firm*—Gerald E. Hespos; Anthony J. Casella

(57) ABSTRACT

A male terminal fitting (10) has a rectangular tubular main portion (12) and a tab (13) that are coupled via a coupling portion (14). The tab (13) is a substantially rectangular tube with a separation along one side. The coupling portion (14) has a bottom wall (14*a*), left and right side walls (14*b*, 14*d*) extend from the opposite sides of the bottom wall. A ceiling wall (14*c*) projects from the left side wall (14*b*) and is opposed to the bottom wall (14*a*). The ceiling wall (14*c*) and the right side wall (14*d*) are separated so that this separation is continuous with the separation (19) of the tab (13). The respective walls (14*a*, 14*b*, 14*c*, 14*d*) are unitary with the front end of the main portion (12).

13 Claims, 4 Drawing Sheets

MALE TERMINAL FITTING

BACKGROUND OF THE INVENTION

1. Field of the Invention

The invention relates to a male terminal fitting.

2. Description of the Related Art

U.S. Pat. No. 5,664,974 and FIG. 5 herein disclose a male terminal fitting with a tab. As shown in FIG. 5, the male terminal fitting has a main portion 1 and a tab 2 coupled by a coupling portion 3. The tab 2 has a separation 2*a* at a side that is not to be held in contact with a mating female terminal fitting to stabilize a contact state with the female terminal fitting to be brought electrically into contact with the upper and lower surfaces of the tab 2. The coupling portion 3 is a substantially rectangular tube with a bottom wall 3*a* and a right side wall 3*b* that are separated along a separation that is continuous with the separated portion 2*a*.

The bottom wall 3*a* and a left side wall 3*c* of the coupling portion 3 are coupled to the tab 2 and the main portion 1. However, a ceiling wall 3*d* is coupled only to the tab 2 and is separated from the main body 1. The right side wall 3*b* projects from the ceiling wall 3*d* and is separated from the tab 2 and the main portion 1. Thus, the coupling portion 3 tends to lack strength. There is a possibility that the coupling portion 3 cannot support the tab 2 in response to a force to vertically pivot the tab 2, and hence the coupling portion 3 may be deformed.

The present invention was developed in view of the above problem and an object thereof is to enhance the strength of a coupling portion.

SUMMARY OF THE INVENTION

The invention is a male terminal fitting formed by bending, folding and/or embossing a flat blank stamped or cut from a base material. The terminal fitting has a substantially tubular main portion and a tab configured for contacting a mating female terminal fitting. The tab is substantially in the form of a tube with a longitudinal separation and is coupled to the main portion by a coupling portion. The coupling portion comprises a first coupling wall, second and third coupling walls extending from the opposite side edges of the first coupling wall, and a fourth coupling wall projecting from the second coupling wall and substantially opposed to the first coupling wall. The coupling portion is substantially a tube separated between the third and fourth coupling walls so that the separation of the coupling portion is substantially continuous with the separation of the tab. The first, second, third and fourth coupling walls are connected with the main portion. Thus, the coupling portion is difficult to deform even if a force acts on the tab in a direction intersecting with the longitudinal direction of the tab.

The separation of the tab is at a position so as not to be held in contact with the mating female terminal fitting.

A projecting end of the fourth coupling wall preferably is held in contact with a projecting end surface of the third coupling wall.

The coupling portion can be kept substantially in the form of a tube by holding the fourth wall in contact with the fourth wall. Thus, the strength of the coupling portion is enhanced further.

A protection wall preferably projects forward from a front end of the main portion to cover at least part of the third coupling wall.

The protection wall preferably is bent to incline forward substantially along fourth coupling wall, while preferably being spaced slightly up from the fourth coupling wall.

At least part of the coupling walls preferably are formed to narrow toward the front ends.

The substantially tubular main portion preferably comprises a first wall that extends substantially in a longitudinal direction. Second and third walls project from the opposite edges of the first wall. A fourth wall projects from the second wall and is substantially opposed to the first wall. A fifth wall projects from the third wall and is placed on or near the fourth wall portion.

The fifth wall preferably is formed with an indent that opens outwardly and laterally. A projecting piece provided at the projecting end of the fourth wall and preferably is inserted into the indent to be held substantially in contact with an end surface of the third wall.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A male terminal fitting according to the invention is identified by the numeral 10 in FIGS. 1 to 4. The male terminal fitting 10 is crimped, folded or bent into connection with a wire (not shown). In the following description, a side that is mated with an unillustrated mating female terminal fitting (left side in FIG. 1) is referred to as the front end, and the opposite end is referred to as the rear end.

Figure 1:
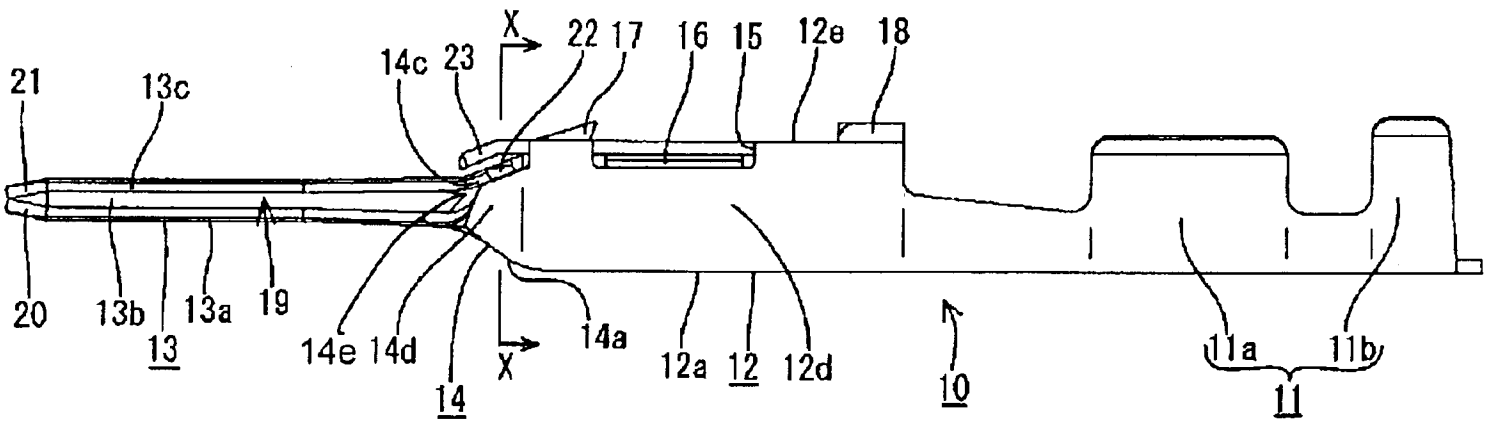
FIG. 1 is a side view of a male terminal fitting according to one embodiment of the invention.
Figure 4:
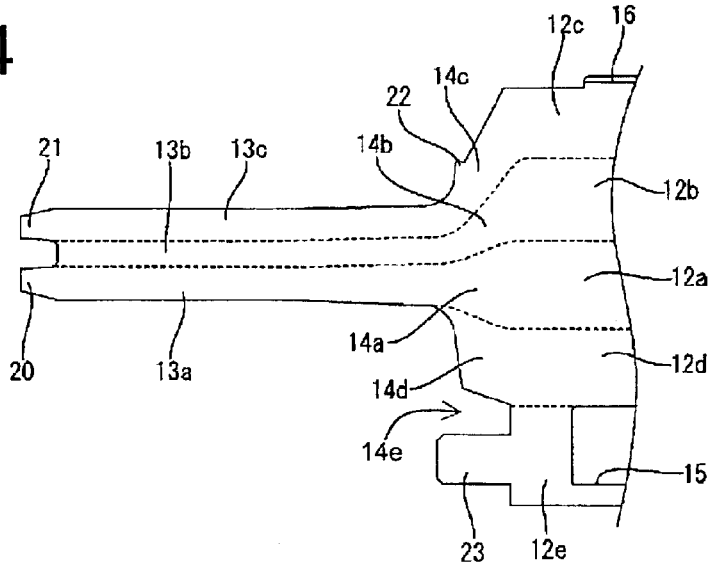
FIG. 4 is a partial plan view showing a development of the male terminal fitting.
Figure 5:
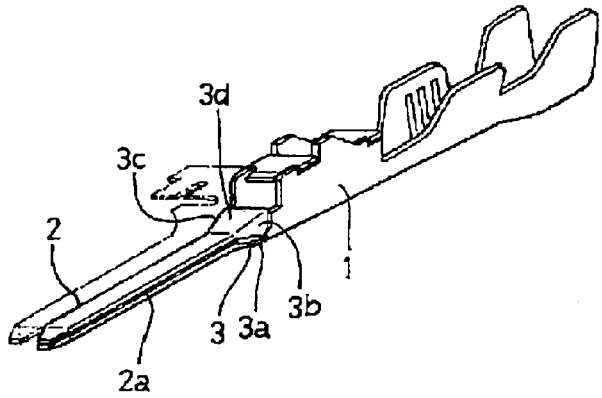
FIG. 5 PRIOR ART
FIG. 5 is a perspective view of a prior art male terminal fitting.

The male terminal fitting 10 is formed into the shape shown in FIG. 1 by bending, folding and/or embossing a blank stamped or cut from a conductive metallic plate to have a shape shown in FIG. 4. The male terminal fitting 10 has a barrel 11 with front and rear pairs of crimping pieces 11*a*, 11*b* to be crimped, bent or folded into connection with an end of a wire. The male terminal fitting 10 also has a substantially rectangular tubular main portion 12 forward of the barrel 11, a tab 13 is forward of the main portion 12 and is brought electrically into contact with an unillustrated mating female terminal fitting. A coupling portion 14 couples the main portion 12 and the tab 13.

Figure 2:
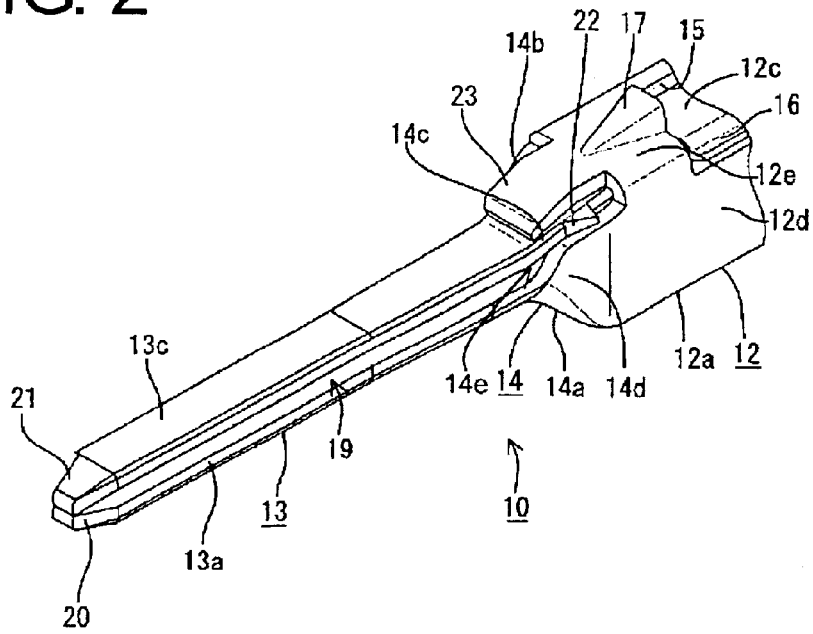
FIG. 2 is a partial perspective view of the male terminal fitting.

As shown in FIG. 2, the main portion 12 has a bottom wall extending in forward and backward directions. The term "bottom" is used herein to provide a convenient reference, and is not intended to imply a required gravitational orientation. Sidewalls 12*b*, 12*d* extend up from the opposite lateral edges of the bottom wall. A ceiling wall 12*c* projects in to the right from the upper end of the left sidewall 12*b* of FIG. 2 and is substantially opposed to the bottom wall. An outer wall 12*e* projects in to the left from the upper end of the right side wall 12*d* and is placed on the outer surface of the ceiling wall 12*c*. The outer wall 12*e* is formed with a substantially rectangular indent 15 that opens up and right, and a projecting piece 16 at the projecting end of the ceiling wall 12*c* is inserted into the indent 15 for contact with the upper end surface of the right sidewall 12*d*. An upward-projecting protrusion 17 is provided at the front edge of the indent 15 by embossing and/or by cutting and bending. Further, an upwardly projecting stabilizer 18 is provided at the rear end of the outer wall 12*e*. Thus, the protrusion 17 and the stabilizer 18 project substantially in the same direction.

The tab 13 is substantially in the form of a rectangular tube and the right side in FIG. 2 is separated. The tab 13 has a bottom wall 13*a* and a sidewall 13*b* that extends from the left edge of the bottom wall 13*a*. A ceiling wall 13*c* projects to the right from the upper end of the sidewall 13*b* and is substantially opposed to the bottom wall 13*a*. Thus, the tab 13 has a substantially U-shaped cross section that opens to the right. The tab 13 is brought resiliently into contact with a receiving portion and a resilient contact piece of the mating female terminal fitting while being held from vertically opposite sides. The lower surface of the bottom wall 13*a* and the upper surface of the ceiling wall 13*c* serve as contact surfaces. Specifically, the female terminal fitting is not to be held in contact with a separated portion 19 of the tab 13. Guiding walls 20, 21 project forward from the front ends of the bottom wall 13*a* and the ceiling wall 13*c*, respectively, and are bent obliquely in so that the front ends thereof are brought closer to each other to guide a connecting operation with the mating female terminal fitting.

Figure 3:
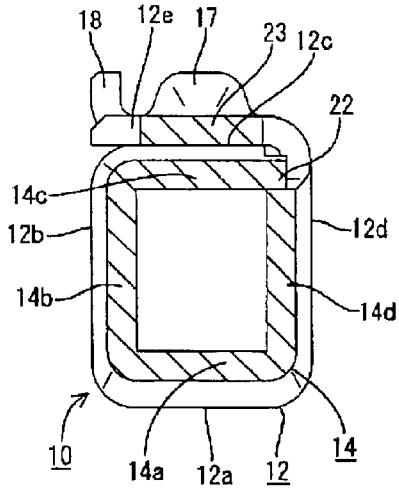
FIG. 3 is a section along 3—3 of FIG. 1.

The coupling portion 14 tapers from the main portion 12 toward the tab 13, as shown in FIG. 2, and is substantially of a rectangular cross section at all locations along its length. The coupling portion 14 includes a bottom wall 14*a* and left sidewall 14*b* extends up from the left side edge of the bottom wall 14*a*, as shown in FIG. 3. A ceiling wall 14*c* projects in to the right from the upper end of the first sidewall 14*a* and substantially opposes the bottom wall 14*a*. A right side wall 14*d* extends up from the right side edge of the bottom wall 14*a*. A separation 14*e* exists between the ceiling wall 14*c* and a right side wall 14*d* and is substantially continuous with the separation 19 of the tab 13. The rear ends of the walls 14*a*, 14*b*, 14*c*, 14*d* of the coupling portion 14 are connected with the front ends of the respective walls 12*a*, 12*b*, 12*c*, 12*d* of the main portion 12 excluding the outer wall 12*e* over substantially the entire periphery (see FIG. 4). The widths of the respective walls 14*a*, 14*b*, 14*c*, 14*d* are reduced toward the front ends, as shown in FIG. 2, and the front ends of the walls 14*a*, 14*b* and 14*c* are connected with the respective walls 13*a*, 13*b* and 13*c* of the tab 13 over substantially the entire periphery. The front end of the left sidewall 14*b* of the coupling portion 14 is connected with the bottom wall 13*a* of the tab 13.

A substantially triangular supporting projection 22 projects to the right from the projecting end of the ceiling wall 14*c*, and is held substantially in contact with the upper end surface of the right sidewall 14*d*. Thus, the coupling portion 14 can be kept substantially in the form of a converging rectangular tube. A protection wall 23 projects forward from the front end of the outer wall 12*e* of the main portion 12 and is disposed above the ceiling wall 14*c*. The protection wall 23 is bent to incline forward substantially along the ceiling wall 14*c*, and is arranged to substantially cover the ceiling wall 14*c* over substantially the entire length while being slightly spaced up from the ceiling wall 14*c*. The protection wall 23 prevents external matter from directly interfering with the ceiling wall 14*c* and can prevent the ceiling wall 14*c* from undergoing an outward-turning deformation.

As described above, all of the walls 14*a*, 14*b*, 14*c*, 14*d* of the coupling portion 14 are connected with the main portion 12. Thus, the coupling portion 14 has a high strength as compared to the prior art coupling portion that is partially separated from the main portion. Therefore, the coupling portion 14 is difficult to deform even if a force acts to pivot the tab 13 vertically in directions intersecting the longitudinal axis of the tab 13.

Further, the supporting projection 22 projects from the ceiling wall 14*c* and contacts the upper end surface of the sidewall 14*d*. Thus, the coupling portion 14 can be kept substantially in the form of a converging rectangular tube and the strength of the coupling portion 14 is enhanced.

The invention is not limited to the above described and illustrated embodiment. For example, the following embodiments also are embraced by the technical scope of the present invention as defined in the claims. Beside the following embodiments, various changes can be made without departing from the scope and spirit of the present invention as defined in the claims.

The supporting projection that projects from the ceiling wall is held substantially in contact with the sidewall in the foregoing embodiment. However, the supporting projection may be omitted and the projecting distance of the ceiling wall may be increased instead. This projecting end may be held substantially in contact with the sidewall. Alternatively, the supporting projection may be omitted and the projecting end surface of the ceiling wall may be held substantially in contact with the inner surface of the sidewall and/or the ceiling wall and the sidewall may be separated from each other according to the present invention.

The tab has a substantially U-shaped cross section opening sideways in the foregoing embodiment. However, the tab may have a closed tubular shape by bringing the opposite edges of the separated portion substantially into contact according to the invention.

The male terminal fitting is configured for crimped connection with the wire in the foregoing embodiment. However, the present invention also is applicable to male terminal fittings to be connected with wires by other means, such as by insulation displacement, soldering and/or press-fit.

What is claimed is:

1. A male terminal fitting formed from a blank stamped from a base material and having a substantially tubular main portion and a tab for contacting a mating female terminal fitting, the main portion and the tab being coupled via a coupling portion, the tab being substantially in the form of a tube partially separated with respect to a peripheral direction to form a separation, wherein:

the coupling portion comprises a first coupling wall, second and third coupling walls extending from opposite sides of the first coupling wall, and a fourth coupling wall projecting from the second coupling wall and substantially opposed to the first coupling wall, the coupling portion being substantially in the form of a tube with a separation between the fourth coupling wall and the third coupling wall such that the separation is substantially continuous with the separation of the tab, the first coupling wall, the second and third coupling walls and the fourth coupling wall being connected with the main portion, and a protection wall projecting forward from a front end of the main portion so as to at least partly cover the fourth coupling wall.

2. The male terminal fitting of claim 1, wherein the protection wall is bent to incline forward substantially along fourth coupling wall, while being slightly spaced up from the fourth coupling wall.

3. The male terminal fitting of claim 1, wherein at least one of the coupling walls has a width that decreases toward the tab.

4. The male terminal fitting of claim 1, wherein the separated portion of the tab is at such a position so as not to be held in contact with the mating female terminal fitting.

5. The male terminal fitting of claim 4, wherein a projecting end of the fourth coupling wall is held substantially in contact with a projecting end surface of the third coupling walls.

6. A male terminal fitting formed from a blank stamped from a base material and having a substantially tubular main portion and a tab for contacting a mating female terminal fitting, the main portion and the tab being coupled via a coupling portion, the tab being substantially in the form of a tube partially separated with respect to a peripheral direction to form a separation, wherein:

the coupling portion comprises a first coupling wall, second and third coupling walls extending from opposite sides of the first coupling wall, and a fourth coupling wall projecting from the second coupling wall and substantially opposed to the first coupling wall, the coupling portion being substantially in the form of a tube with a separation between the fourth coupling wall and the third coupling wall such that the separation is substantially continuous with the separation of the tab.

the first coupling wall, the second and third coupling walls and the fourth coupling wall being connected with the main portion, wherein the substantially tubular main portion comprises a first wall extending substantially in a longitudinal direction, second and third walls projecting from opposite edges of the first wall, a fourth wall projecting from one of the second and third walls and being substantially opposed to the first wall, and a fifth wall projecting the other of the second and third walls and placed substantially on the fourth wall.

7. The male terminal fitting of claim 6, wherein the fifth wall is formed with an indent which is open outwardly and laterally, and a projecting piece being provided at the projecting end of the fourth wall and being at least partly inserted into the indent and held substantially in contact with the third wall.

8. A male terminal fitting unitarily formed from a conductive material and having opposite front and rear ends, the male terminal fitting comprising:

a substantially rectangular tubular main portion disposed between the front and rear ends, the main portion having a main bottom wall, opposed first and second main sidewalls extending up from the main bottom wall and a main ceiling wall opposed to the main bottom wall;

a tab at the front end and being cross sectionally smaller than the main portion; and a substantially converging tubular coupling portion extending from the main portion to the tab, the coupling portion having a bottom coupling wall extending unitarily from the main bottom wall, first and second side coupling walls extending unitarily from the bottom coupling wall, the first side coupling wall extending unitarily from the first main sidewall and the second side coupling wall extending unitarily from the second main sidewall and a ceiling coupling wall extending unitarily from both the first side coupling wall and the main ceiling wall.

9. The male terminal fitting of claim 8, wherein the second side coupling wall has a top edge remote from the bottom coupling wall, the terminal fitting further having a supporting projection projecting from the ceiling coupling wall and contacting the top edge of the second side coupling wall.

10. The male terminal fitting of claim 9, wherein the coupling portion has a separation between the second side coupling wall and the ceiling coupling wall and wherein the tab has a longitudinal separation substantially aligned with the separation of the coupling portion.

11. The male terminal fitting of claim 9, wherein the coupling portion is of substantially rectangular cross section.

12. The male terminal fitting of claim 9, further comprising a main outer wall extending unitarily from the second main sidewall and disposed over the main ceiling wall and a protection wall projecting forward from a front end of the main outer wall so as to cover at least part of the ceiling coupling wall.

13. The male terminal fitting of clam 12, wherein the protection wall is bent to incline forward substantially along ceiling coupling wall, while being slightly spaced up from the ceiling coupling wall.

* * * * *